United States Patent [19]

Puckett et al.

[11] Patent Number: 4,836,552

[45] Date of Patent: Jun. 6, 1989

[54] SHORT DISTANCE GOLF BALL

[75] Inventors: Troy L. Puckett; Lauro C. Cadorniga, both of Albany, Ga.

[73] Assignee: MacGregor Golf Company, Albany, Ga.

[21] Appl. No.: 795,803

[22] Filed: Nov. 7, 1985

Related U.S. Application Data

[63] Continuation-in-part of Ser. No. 588,190, Mar. 12, 1984, abandoned.

[51] Int. Cl.[4] ..... A63B 37/00

[52] U.S. Cl. ..... 273/218; 273/199 R; 273/DIG. 22; 273/DIG. 20

[58] Field of Search ..... 273/218, 220, 60 B, 273/DIG. 22, 58 A, 219, 199 R, DIG. 8, DIG. 20

[56] References Cited

U.S. PATENT DOCUMENTS

| | | | |
|---|---|---|---|
| 1,345,904 | 7/1920 | Wishart | 273/218 |
| 1,447,516 | 12/1923 | Miller | 273/220 |
| 1,812,285 | 6/1931 | Christie | 273/218 |
| 3,069,170 | 12/1962 | Dillon | 273/199 |
| 3,288,469 | 11/1966 | Shaw | 273/199 |
| 3,313,545 | 4/1967 | Bartsch | 273/218 |
| 3,373,123 | 3/1968 | Brice | 273/218 X |
| 3,421,766 | 1/1969 | Chmiel et al. | 273/218 |
| 3,454,676 | 7/1969 | Busse | 273/218 X |
| 3,478,134 | 11/1969 | Gruss et al. | 273/DIG. 8 |
| 3,502,338 | 3/1970 | Cox | 273/218 |
| 3,572,721 | 3/1971 | Harrison et al. | 273/218 |
| 3,804,421 | 4/1974 | Alex et al. | 273/218 |
| 3,883,145 | 5/1975 | Cox et al. | 273/218 |
| 3,940,145 | 2/1976 | Gentiluomo | 273/220 |
| 3,979,126 | 9/1976 | Dusbiber | 273/218 |
| 4,085,937 | 4/1978 | Schenk | 273/220 X |
| 4,141,559 | 2/1979 | Melvin et al. | 273/220 |
| 4,211,407 | 7/1980 | Tomar | 273/60 B |
| 4,611,810 | 9/1986 | Kamata et al. | 273/218 |
| 4,688,801 | 8/1987 | Reiter | 273/218 |

FOREIGN PATENT DOCUMENTS

| | | | |
|---|---|---|---|
| 494732 | 2/1978 | Australia | 273/60 B |
| 2938773 | 9/1979 | Fed. Rep. of Germany . | |
| 649217 | 1/1951 | United Kingdom | 273/218 |
| 1136166 | 2/1966 | United Kingdom . | |

*Primary Examiner*—George J. Marlo

*Attorney, Agent, or Firm*—Jones, Askew & Lunsford

[57] ABSTRACT

A one-piece short distance golf ball has a dense outer skin and a cellular core structure. The golf ball is the same size as a conventional ball (approximately 1.68 inches in diameter), is approximately half the weight of a conventional ball (15–35 grams), and plays approximately half as far as a conventional ball. The short distance golf ball is a lively ball with a rebound between 50% and 80%. The golf ball comprises a foam-molded thermoplastic polymer (approximately 100 parts) and a filler (approximately 0.5 to 15 parts). The thermoplastic polymer is Surlyn, and the filler material is preferably glass bubbles having a density between 0.12 and 0.18 grams per cubic centimeter. In addition the golf ball may have a brambled surface which helps the ball resist the effects of cross winds.

11 Claims, 2 Drawing Sheets

SHORT DISTANCE GOLF BALL

RELATED APPLICATION

This application is a continuation-in-part of our application Ser. No. 588,190, filed Mar. 12, 1984 now abandoned.

BACKGROUND OF THE INVENTION

This invention relates generally to a short distance golf ball and more particularly concerns compositions and methods for manufacturing a short distance golf ball which has performance characteristics comparable to that of a conventional golf ball except that it plays from 30%–70% shorter in distance than a conventional golf ball.

A conventional 18-hole golf course occupies approximately 180 acres of land. Because of the availability and cost of land in metropolitan areas and in resort areas where golf courses are frequently built, it is desirable to be able to design a golf course which uses substantially less acreage but at the same time presents all of the challenges of a conventional golf course. By providing a short distance golf ball which will play approximately 50% of the distance of a conventional golf ball, the land requirements for a golf course can be reduced 67% to 50%.

In order for a golfer to realize the ordinary training and practice benefits as well as the enjoyment associated with playing a conventional ball on a conventional course, the short distance golf ball must perform in a manner substantially similar to a conventional ball except that the distance it flies must be approximately 50% shorter. In order to play comparably to a conventional ball, the short distance golf ball must be maneuverable in play, which means that the golfer must be able to draw or fade, to hook or slice, or to hit high or low shots with the short distance ball much the same as with a conventional golf ball. In addition, the short distance ball when struck by a putter on a green must perform essentially the same as a conventional golf ball. The golfer must also be able to impart sufficient backspin to the short distance ball when properly struck by a medium or short iron to make the short distance golf ball "bite" or "hold" the green to the same degree possible with a conventional golf ball when it is struck in the same manner. The short distance golf ball must perform the same as a conventional ball in terms of flight and green holding when it is hit from sand bunkers.

If the short distance golf ball has the above listed attributes, the golfer can play the short distance golf ball on a short golf course, use all of his clubs, and achieve the same practice and training benefits as well as the enjoyment associated with playing on a conventional golf course, in about half the time on a golf course that occupies about half the acreage of a conventional golf course.

SUMMARY OF THE INVENTION

We have discovered that a short distance golf ball having the characteristics described above cannot be provided by simply reducing the resilience of a conventional golf ball thereby reducing the initial velocity of the ball off of the face of the club. Such a "dead ball", even with a special aerodynamic dimple design to maximize lift, will not produce the lift necessary to give the trajectory of a conventional ball which weighs approximately 45 grams It is therefore the object of the present invention to provide a short distance golf ball for use on a shortened golf course which provides essentially the same performance characteristics of a conventional golf ball except that its playing distance is from 30% to 70% shorter than a conventional golf ball.

In order to achieve that objective, we have discovered that a lighter golf ball than a conventional ball is required which is easier to spin off of the face of the club and which has less gravitational force to overcome. In order to produce such a short distance golf ball, a one-piece golf ball is molded from a thermoplastic material which is sufficiently light (low specific gravity) and at the same time has the resilience to fly properly and the rigidity to withstand the impact o-f standard golf clubs without permanent deformation.

The thermoplastic material comprises a thermoplastic polymer and microscopic glass bubbles. The glass bubbles are uniformly distributed throughout the polymer and fill the interstitial spaces of the thermoplastic polymer The one-piece, short distance golf ball is manufactured by mixing the thermoplastic polymer and the glass bubbles with a chemical blowing agent. The resulting mixture is injected into a golf ball mold cavity to form the short distance golf ball. By regulating the amount of the mixture injected, the amount of blowing agent, and the other process parameters, the resulting one-piece, molded golf ball has a dense skin adjacent its outside surface and has a cellular core. The thickness of the golf ball's skin establishes the moment of inertia for the golf ball. The ball's moment of inertia, of course, determines how much spin can be imparted to the ball when struck by a golf club.

Further objects and advantages of the invention will become apparent upon reading the following detailed description and upon reference to the drawing.

DETAILED DESCRIPTION OF THE PREFERRED EMBODIMENT

While the invention will be described in connection with a preferred embodiment and process, it will be understood that we do not intend to limit the invention to that embodiment and/or process. On the contrary, we intend to cover all alternatives, modifications, and equivalents as may be included within the spirit and scope of the invention as defined by the appended claims.

Figure 1:
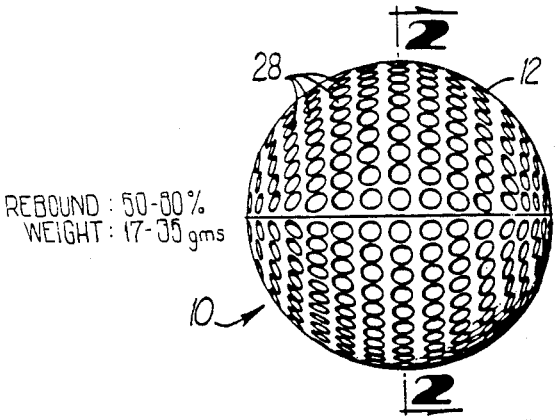
FIG. 1 is a front face view of a dimpled golf ball of the present invention.

Turning to FIG. 1, there is shown a golf ball 10 which embodies the present invention. The golf ball 10 is approximately 1.68 inches in diameter, the same size as a conventional golf ball, and weighs approximately 15 to 30 grams as compared to approximately 45 grams for a conventional golf ball. The golf ball 10 is a one-piece golf ball made of a thermoplastic material 12. The golf ball 10 is formed by injection molding in conjunction with a chemical blowing agent. The precise composition of the thermoplastic material and the process for injection molding the golf ball will be described in greater detail below.

Figure 2:
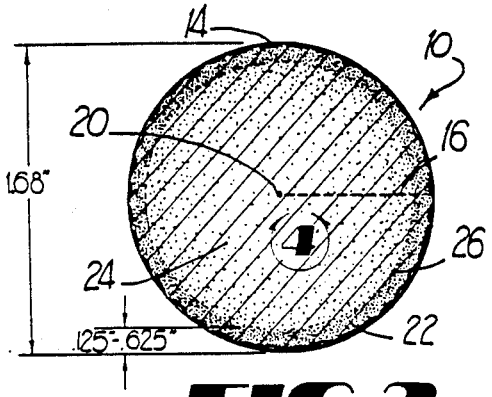
FIG. 2 is a cross section of the golf ball of FIG. 1 as taken along lines 2—2.
Figure 4:
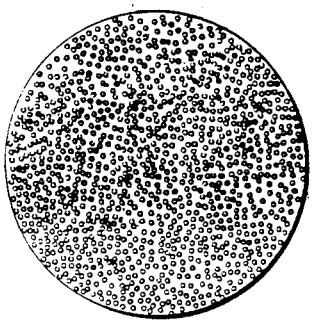
FIG. 4 is an enlarged sectional view of a portion of the cellular internal structure of the golf ball of the present invention.
Figure 5:
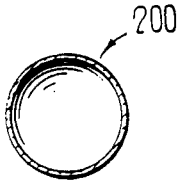
FIG. 5 is an enlarged view of a hollow glass bubble used as a filler in the golf ball of the present invention.

With reference to FIG. 2, the cross section of the golf ball 10 illustrates that the density of the thermoplastic material 12 increases along the radius 16 of the golf ball from the center 20 to the surface 14. The golf ball 10 has an outer dense skin 22 of from 0.125 inch to 0.625 inch in thickness. Preferrably the skin's thickness, which is inversely related to the amount of blowing agent used in making the golf ball, is approximately 0.250 inch. The core 24 of the golf ball 10 has a blown cellular structure. The boundary 26 between the cellular core 24 and the skin 22, while not sharply delineated, is observable from an inspection of a cross sectional sample of a golf ball made in accordance with the present invention.

The golf ball 10 has dimples 28 (FIG. 1) which are formed during the injection molding process by the mold pattern. The dimples 28 are formed at the surface 14 in any conventional dimple pattern that can be used on a conventional dimpled golf ball. In the preferred embodiment, however, brambled golf ball 110 shown in FIG. 3 has surface bumps 128 instead of dimples, which bumps help the ball resist the effects of the wind while in flight. Dimpled golf ball 10 and brambled golf ball 110 are finished in the conventional manner by painting the golf balls either white, yellow, orange, or any other suitable color.

The weight and density distribution of the thermoplastic material in the golf ball of the present invention assures that the golf ball will perform in most respects the same as a conventional golf ball except that its playing distance will be shorter. The short distance golf ball of the present invention has a rebound of from 50% to 80% and preferrably 67%. the golf ball has a compression of from 0 to 100 as measured on the Atti compression tester, and the compression is preferably 60.

The thermoplastic material 12 from which the golf ball is made comprises a thermoplastic polymer with microscopic glass bubbles distributed uniformily throughout the interstitial spaces of the polymer. The thermoplastic polymer is preferrably the product of the reaction of an olefin and metallic salt of an unsaturated monocarboxylic acid. Suitable ionomer resins for producing the thermoplastic polymer are sold by the Dupont Company, Polymer Products Department, Ethylene Polymers Division, Wilmington, Del., 19898, under the trademark SURLYN. The Surlyn resin is available both as a zinc ionic copolymer and as a sodium ionic copolymer. It has been found that each copolymer is useful in carrying out the present invention and that mixtures of the two copolymers are likewise useful in carrying out the present invention.

The thermoplastic material, as previously stated, includes microscopic glass bubbles which serve as filler or extender. In the finished product the glass bubbles are distributed uniformly throughout the thermoplastic polymer. The glass bubbles which are useful in carrying out the present invention are manufactured by the 3M Company, St. Paul, Minn. 55101 and range in density from 0.12 to 0.18 grams per cubic centimeter. Other inorganic fillers such as titanium dioxide or calcium carbonate can be used in manufacturing the short distance golf ball. The glass bubbles are preferred because they improve impact resistance by functioning as a nucleating agent.

In order to manufacture a ball of the above-described composition and having the physical and performance characteristics previously described, the golf ball is formed by injection molding with a blowing agent. Typical blowing agents, such as Freon, nitrogen gas, and carbon dioxide, may be used with Surlyn. A suitable chemical blowing agent for carrying out the present invention has a decomposition temperature range between 230° F. and 435° F. Two preferred chemical blowing agents are sold under the trade designation Celogen TSH and Celogen RA by Uniroyal Chemical, Naugatuck, Conn. 06770. Norteck brand foam concentrate sold by Northern Petro Chemical Company, Clinton, Mass. 01510 also works well.

While the process operates over a wide range of blowing agent decomposition temperatures, higher decomposition temperatures are preferrable because the risk of premature expansion can be minimized. Thus decomposition temperatures from 350° F. to 450° F. are perferred.

The following formulations have been found to produce acceptable golf balls which have approximately 250 inch thick skin and which have the physical and performance characteristics desired for short distance golf ball.

| Material | Parts (by weight) |
|---|---|
| Surlyn Ionomer Resin 1605 | 50 |
| Surlyn Ionomer Resin 1706 | 50 |
| Glass Bubbles (C15/250 by 3M) | 6.25 |
| Celogen TSH | 1.06 |

EXAMPLE 2

| Material | Parts (by weight) |
|---|---|
| Surlyn Ionomer Resin 1855 | 100 |
| Glass Bubbles (C15/250 by 3M) | 6.25 |
| Celogen TSH | 1.06 |

EXAMPLE 3

| Material | Parts (by weight) |
|---|---|
| Surlyn Ionomer Resin 1856 | 100 |
| Glass Bubbles (C15/250 by 3M) | 6.25 |
| Celogen TSH | 1.06 |

EXAMPLE 4

| Material | Parts (by weight) |
|---|---|
| Surlyn Ionomer Resin 1855 | 50 |
| Surlyn Ionomer Resin 1856 | 50 |
| Glass Bubbles (C15/250 by 3M) | 6.25 |
| Celogen TSH | 1.06 |

EXAMPLE 5

| Material | Parts (by weight) |
|---|---|
| Surlyn Ionomer Resin 1855 | 50 |
| Surlyn Ionomer Resin 1856 | 50 |
| Glass Bubbles (SSX by 3M) | 3.0 |

-continued

| Material | Parts (by weight) |
|---|---|
| Celogen RA | 1.5 |

EXAMPLE 6

| Material | Parts (by weight) |
|---|---|
| Surlyn Ionomer Resin 1855 | 50 |
| Surlyn Ionomer Resin 1856 | 50 |
| Glass Bubbles (SSX by 3M) | 3.0 |
| Titanium Dioxide | 0.5 |
| Celogen RA | 0.5 |

EXAMPLE 7

| Material | Parts (by weight) |
|---|---|
| Surlyn Ionomer Resin 1855 | 50 |
| Surlyn Ionomer Resin 1605 | 50 |
| Glass Bubbles (SSX by 3M) | 3.0 |
| Titanium Dioxide | 0.5 |
| Celogen RA | 0.5 |

EXAMPLE 8

| Material | Parts (by weight) |
|---|---|
| Surlyn Ionomer Resin 1706 | 50 |
| Surlyn Ionomer Resin 1856 | 50 |
| Glass Bubbles (SSX by 3M) | 3.0 |
| Titanium Dioxide | 0.5 |
| Celogen RA | 0.5 |

EXAMPLE 9

| Material | Parts (by weight) |
|---|---|
| Surlyn Ionomer Resin 1855 | 50 |
| Surlyn Ionomer Resin 1856 | 50 |
| Glass Bubbles (SSX by 3M) | 3.0 |
| Titanium Dioxide | 0.5 |
| Norteck 1039 | 0.5 |

EXAMPLE 10

| Material | Parts (by weight) |
|---|---|
| Surlyn Ionomer Resin 1706 | 50 |
| Surlyn Ionomer Resin 1605 | 50 |
| Glass Bubbles (SSX by 3M) | 2.5 |
| Class Bubbles (C15/250 by 3M) | 2.5 |
| Blue Concentrate (95 percent Titanum Dioxide + 5 percent Surlyn carrier) | 5.0 |
| Nortech MF 1039 | 1.125 |
| Celogen TSH | .125 |

EXAMPLE 11

| Material | Parts (by weight) |
|---|---|
| Surlyn Ionomer 1706 | 25 |
| Surlyn Ionomer 1605 | 75 |
| Glass Bubbles (SSX by 3M) | 5.0 |
| Blue Concentrate (95 percent Titanum Dioxide + 5 percent Surlyn carrier) | 5.0 |

-continued

| Material | Parts (by weight) |
|---|---|
| Norteck 1039 | 1.25 |

The thickness of the skin of the finished golf ball is inversely proproportional to the amount of blowing agent. For example, reducing the amount of Celogen TSH to 0.50 parts will produce a skin thickness of approximately 0.500 inch in the finished golf ball. Therefore a range of 0.50 to 2.00 parts of blowing agents should produce skin thickness from approximately 0.500 inch to 0.125 inch respectively.

The weight of the filler in the formulation can be varied within a range of from 0.5 to 15 parts, and the weight of the glass bubbles may vary from 0 to 10 parts.

In order to form the short distance golf ball of the present invention, the ingredients specified for each of the above formulations are first mixed together prior to injection molding.

A conventional screw injection machine used to manufacture conventional two-piece molded golf balls must be modified for foam molding as set out below. The injection nozzle is equipped with a shut-off valve to insure that only a predetermined amount of the mixture is injected into each mold cavity. Particularly, it is desired that only about 15 to 30 grams of the mixture for each dimpled golf ball 10 be injected. For brambled golf ball 110 an additional 15% of the mixture (about 17 to 35 grams) may be injected to produce a golf ball that is 15% heavier than dimpled golf ball 10. The injection machine must generate sufficient injection pressure to be able to inject the material into the mold cavity in one second or less to minimize premature gas expansion. Also flow channels must be kept short and provide equidistance flow to the extremities of the cavity to achieve uniform skin thickness for each ball molded.

In order to assure that the resulting short distance golf ball has the proper skin thickness, it is important that the process parameters be controlled. The initial temperature of the mixture is room temperature. The mold cavity is chilled by 40° F. water to approximately 40° F. to 70° F. The injection cylinder is provided with a temperature gradient along its length to the nozzle. The rear part of the cylinder is kept at a lower temperature (approximately 325° F.) to reduce premature gas expansion, and the nozzle is maintained at a higher temperature (approximately 400° F.) to make rapid injection easier by reducing viscosity of the mixture. The mold is then held closed (elapsed time) for between 60 and 240 seconds (depending on skin thickness) while maintaining the mold temperature at approximately 40° F. to 70° F. The process requires about 60 seconds per 0.125 inch of skin thickness to insure that the skin is fully molded before the mold is opened. After the specified time has elapsed, the mold is opened, the ball is removed and immediately quenched in cold water to curtail any further blowing.

By mixing the requisite amount of blowing agent and regulating the process within the parameters specified above, the density of the thermoplastic material which forms the short distance golf ball will have the desired skin thickness to provide the performance characteristics required for a short distance golf ball.

We have achieved best results with the following process parameters for golf balls having a skin thickness of approximately 0.250 inch and manufactured from the mixtures specified in examples 1 though 11:

| Process Parameter | Value |
|---|---|
| Initial mold temperature | 40° F.-70° F. |
| Cylinder temperature | |
| rear | 300° F.-350° F. |
| center | 325° F.-375° F. |
| front | 350° F.-400° F. |
| nozzle | 375° F.-450° F. |
| Screw back pressure | 250 psi |
| cure cycle (elapsed time) | 109 sec. |
| Fill rate | 1 sec. or less |

While the golf ball 10 as shown in FIG. 1 with a standard dimple pattern provides suitable performance under most conditions of play, the flight characteristics of the dimpled golf ball 10 under windy conditions vary from the flight characteristics of a conventional ball because the golf ball 10 is anywhere from 15 to 30 grams lighter than a conventional golf ball weighing 45 grams.

Figure 3:
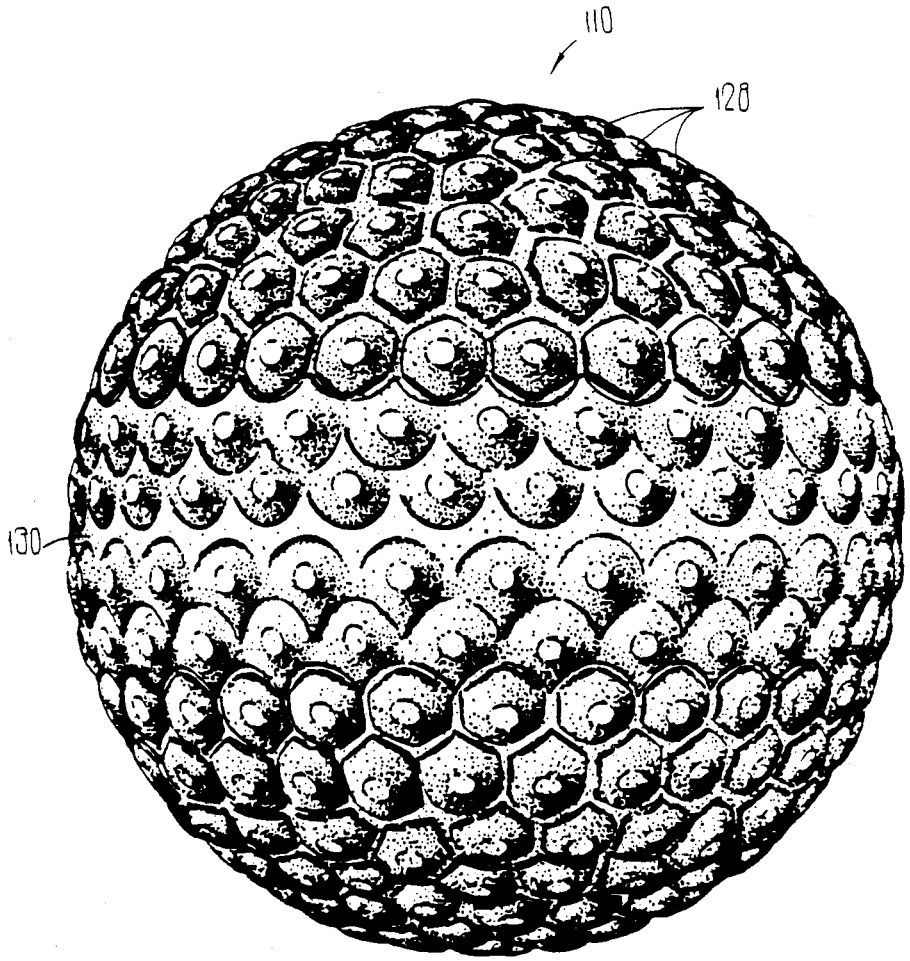
FIG. 3 is a front face view of a brambled golf ball of the present invention.

We have discovered that the flight characteristics of golf ball 10 under windy conditions can be improved by replacing the dimple pattern of golf ball 10 with a surface pattern known as "bramble" which is shown on golf ball 110 in FIG. 3. The bramble pattern shown in FIG. 3 does not have dimples at all but in fact has 398 individual bumps 128. There is also a raised band 130 around the seam of the ball.

The 398 bumps of the bramble pattern are approximately 0.010 inches high in the first row adjacent the raised band, 0.018 inches high in the second row adjacent the raised band, and 0.030 over the rest of the ball. The bumps are arranged in a tetraicosahedron pattern (a delta hedron with 24 sides) which geometric pattern is the same geometric pattern used for dimples on some conventional golf balls, for example, the Muirfield brand golf ball manufactured by MacGregor Golf Company, the assignee of the present invention. The raised band 130 is not crucial to the improved flight characteristics of the brambled ball but is merely provided so that the seam line left by the molding process can be buffed smooth.

By adding the bramble configuration to the golf ball 110, the golf ball 110 has a relatively higher drag than a dimpled ball. As a result, the velocity of the brambled ball 110 is rapidly reduced after it leaves the club face. Because of the reduced velocity resulting from the drag, the brambled ball's weight can be increased. We have found that by increasing the weight of the brambled ball about 15% over the weight of the dimpled ball 10, the distance of the brambled ball is approximately the same as the lighter, lower drag dimpled ball 10. The brambled ball's weight is preferrably between about 17 and 35 grams.

Because the brambled ball 110 is about 15% heavier than the dimpled golf ball 10, its trajectory is not affected by wind as much as the lighter dimpled golf ball 10. Surprisingly, the bramble configuration with its surfact roughness, its relatively high drag, and its turbulent air flow on the surface of the ball even at low velocities, is affected in flight even less by the wind than the smoother dimpled ball.

Also, the bramble pattern appears to eliminate the abrupt transition from turbulent air flow at high velocities to laminar air flow at low velocities across the ball, and that makes the brambled ball more stable in flight, especially under windy conditions (so that the bramble ball does not dart or flutter like a knuckle ball).

The bramble configuration on the golf ball 110 is produced by providing molds which have the requisite complementary surface configuration.

What is claimed is:

1. A one-piece golf ball in the shape of a sphere having a center, a radius, and a surface, and comprising a thermoplastic polymer and a filler material wherein the filler material is uniformly distributed in the polymer and the polymer is foam-molded so that the polymer and filler within the ball have a continuously increasing density gradient along the ball's radius from its center to its surface which density gradient is characterized by a relatively dense outer skin and a cellular core, and wherein the ball has a rebound of between 50% and 80%, weighs between 15 and 35 grams, and is 1.68 inches in diameter.

2. The golf ball of claim 1, wherein the ball has a skin thickness between 0.125 inch and 0.625 inch.

3. The golf ball of claim 1, wherein the golf ball surface has a bramble configuration.

4. The golf ball of claim 3, wherein the bramble configuration has 398 bumps in a tetraicosahedron pattern.

5. The golf ball of claim 1, wherein the filler material is selected from the group consisting of microscopic glass bubbles, titanium dioxide, and calcium carbonate, and the thermoplastic polymer is the product of the reaction of an olefin and a metallic salt of an unsaturated monocarboxylic acid.

6. The golf ball of claim 5, wherein the filler material is microscopic glass bubbles having a density of between 0.12 and 0.18 grams per cubic centimeter.

7. The golf ball of claim 6, wherein the golf ball comprises essentially by weight 100 parts of the thermoplastic polymer and between 0.5 and 15 parts of the filler.

8. The one-piece golf ball having a center, a radius, and a surface, and comprising a thermoplastic material which is the product of the reaction of an olefin and a metallic salt of an unsaturated monocarboxylic acid and a filler material selected from the group consisting of microscopic glass bubbles, titanium dioxide, and calcium carbonate, wherein the golf ball comprises essentially by weight 100 parts of the thermoplastic polymer and between 0.5 and 15 parts of the filler and wherein the filler material is uniformly distributed in the polymer and the polymer is foam-molded so that the polymer and filler within the ball have a continuously increasing density gradient along the ball's radius from its center to its surface which density gradient is characterized by a relatively dense outer skin and a cellular core and wherein the ball has skin thickness between 0.25 inch and 0.625 inch.

9. The golf ball of claim 8, wherein the ball has a rebound between 50% and 80%, weighs between 15 and 35 grams, and is 1.68 inches in diameter.

10. The golf ball of claim 8, wherein the golf ball surface has a bramble configuration.

11. The golf ball of claim 8, wherein the filler material is microscopic glass bubbles having a density of between 0.12 and 0.18 grams per cubic centimeter.

* * * * *